United States Patent [19]

Wilson

[11] 4,123,868

[45] Nov. 7, 1978

[54] GUNPOWDER CHARGE AND PROJECTILE CONTAINER

[76] Inventor: Hugh R. Wilson, 10840 SW. 120th St., Miami, Fla. 33176

[21] Appl. No.: 869,905

[22] Filed: Jan. 16, 1978

[51] Int. Cl.[2] ..... F42B 39/04; F41C 27/00

[52] U.S. Cl. ..... 42/90

[58] Field of Search ..... 42/90, 1 R, 51

[56] References Cited

U.S. PATENT DOCUMENTS

| | | | |
|---|---|---|---|
| 163,404 | 5/1875 | Phillips | 42/90 |
| 243,250 | 6/1881 | Hall | 42/90 |
| 3,775,889 | 12/1973 | Wilburn | 42/90 |
| 4,050,175 | 9/1977 | Mulinix | 42/90 |

OTHER PUBLICATIONS

"Load-N-Cap Speed Loader", *The American Rifleman;* vol. 124, No. 11, p. 42, Nov. 1976.

*Primary Examiner*—Charles T. Jordan

[57] ABSTRACT

The invention is that of a cartridge-like container for containing a pre-measured powder charge, a projectile and a percussion cap ready for quick use in reloading a muzzle-loading firearm. The device comprises a tube open at both ends. The projectile is inserted in one end, the powder from the other end and a cap to contain the powder. A socket is provided on the cap for holding a fresh percussion cap. To use, the cap is removed, the powder poured into the barrel of the gun, the projectile is forced into the barrel by placing the container on the muzzle and pushing the projectile out of the container and into the barrel with a ramrod which is passed through the body of the container. The container is re-usable.

3 Claims, 5 Drawing Figures

GUNPOWDER CHARGE AND PROJECTILE CONTAINER

FIELD OF THE INVENTION

The device is intended to be used with muzzle loading guns for target shooting and for hunting purposes.

DESCRIPTION OF THE PRIOR ART

Although containers have been used in the past for premeasured powder charges, the projectiles were carried separately and requiring lubrication presented a slow and messy job of preparing the projectile before inserting it into the barrel of the gun. The percussion caps were also carried in a separate manner and again required slow handling and usually with sticky fingers as well. This new and novel device allows the projectile to be pre-lubricated before loading into the container and when in the container the lubricant cannot cause a problem of cleanliness to the hands and clothing of the user. The projectile is pushed directly from the container together with the lubricant into the barrel of the firearm so that the user does not have to touch the projectile with his hands. The powder charge is kept from contact with the lubricant by the tight fit of the projectile in the bore of the container. The percussion cap is handy and held securely in the end cap of the container and the holder is shaped so that the cap may be placed over the breech nipple and as the holder is pulled away, the cap will remain in place on the nipple. This invention therefor provides a new and novel means of reloading a muzzle-loading arm in a quick clean, and efficient manner, and the container is re-usable, and can be sold at a moderate price.

SUMMARY OF THE INVENTION

It is an object of this invention to provide a new and novel charge container that is quick, easy and clean to use.

Another object of this invention is to provide a new charge container that is cheap to manufacture and that will make the use of muzzle loading firearms more pleasant and enjoyable.

A further object on this invention is to provide a new and novel charge container that can be completely prepared in advance and which will remain intact until used even in storage.

A BRIEF DESCRIPTION OF THE DRAWINGS

DESCRIPTION OF THE PREFERRED EMBODIMENT

Figure 1:
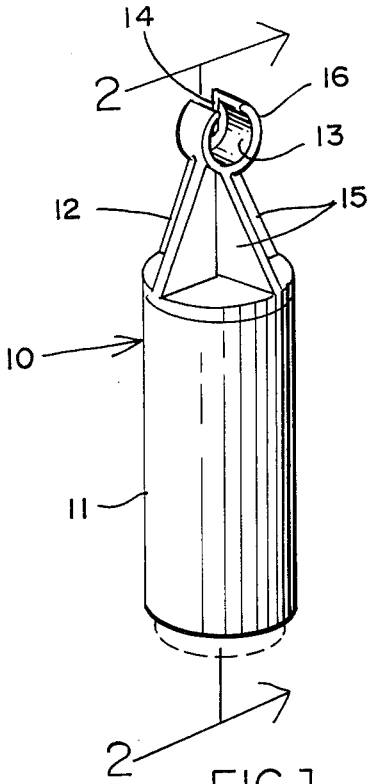
FIG. 1 shows the device with the base of the projectile protruding from the end in broken lines.
Figure 2:
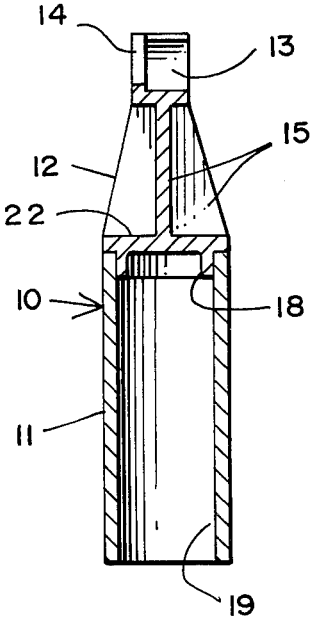
FIG. 2 is a sectional view of an empty container.
Figure 3:
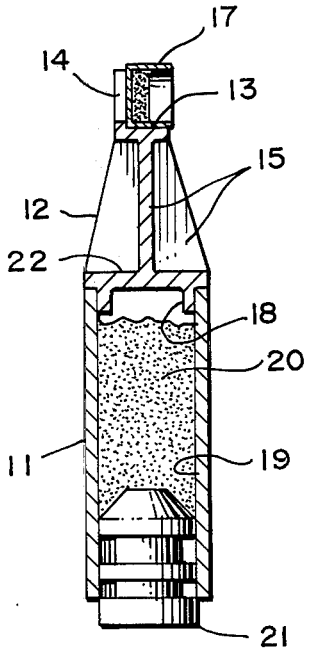
FIG. 3 is a sectional view of the device as loaded with the projectile, powder charge and percussion cap in place.

Referring to the drawings by characters of reference, FIGS. 1–5 illustrate a gunpowder charge and projectile container 10.

Figure 4:
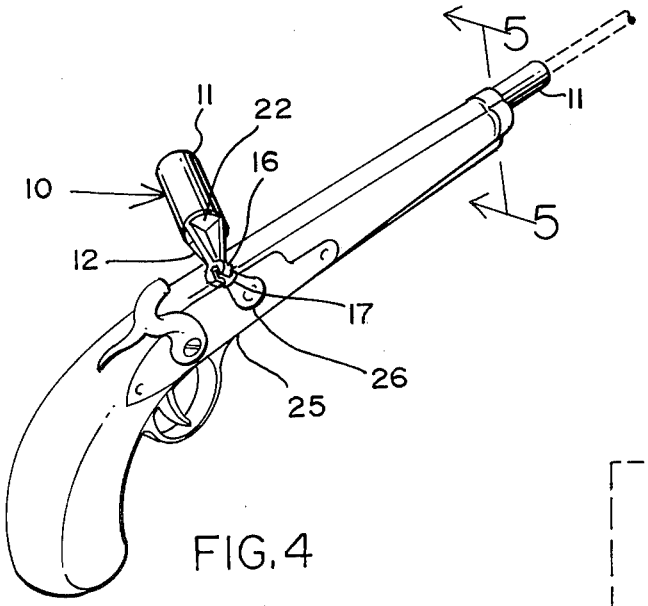
FIG. 4 shows the manner in which the percussion cap is placed upon the breech nipple of a firearm.
Figure 5:
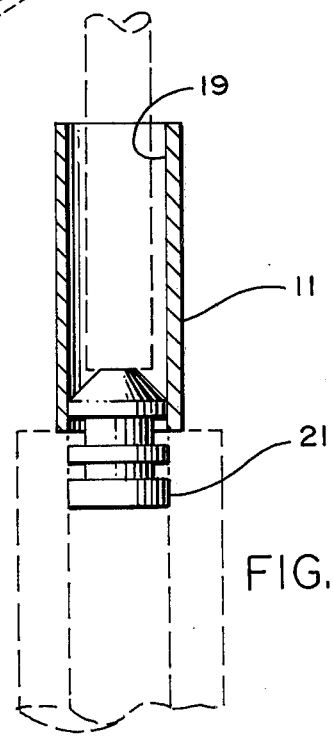
FIG. 5 shows the manner in which the projectile is pushed from the container into the barrel of a firearm with the ramrod and barrel shown in broken lines.

The body 11 is in the form of an open end tube of a yieldable material such as plastic. A projectile 21 is placed in the body 11 from one end. The powder charge 20 is placed in the body 11 and prevented from escaping by the presence of the projectile 21. The container cap 12 is placed in the other open end of the body 11 and is retained in place by the lip 18. The outer diameter of the lip 18 of the container cap 12 and of the projectile 21 are such as to provide a tight fit against the inside wall 19 of the body 11. The container cap 12 may be pressed into the body 11 by pressing on the flat surfaces 22 of the container cap 12. A percussion cap 17 is held by the socket-like cavity 13 which is provided with a split-slot 14 to allow the cavity 13 to deflect from around the percussion cap 17 when the percussion cap 17 is placed on a breech nipple and the container cap 12 is pulled away. The cap holding socket 13 is supported by the ribs 15 forming a part of the container cap 12. The container cap 12, including the percussion cap socket wall 16 is composed of a yeildable material such as a plastic. The manner of attaching the percussion cap 17 to a nipple 26 on illustrated pistol 25 in FIG. 4 is shown.

OPERATION OF THE DEVICE

To use the device, it must first be loaded with the components required. First, a pre-lubricated projectile is inserted into one open end of the body. A premeasured powder charge is then placed into the body from the remaining open end. The container cap is then placed in the open end which closes the container and prevents escape of the powder charge. A fresh percussion cap is then placed into the holding socket at the end of the container cap. When the user is ready to reload the firearm, he removes the container cap, pours the powder charge into the muzzle of the barrel of the firearm, sets the body of the container on the surface of the barrel muzzle with the slightly protruding base of the projectile started into the bore of the firearm. A ramrod is then inserted into the open end of the container body and against the front end of the projectile and the projectile is pushed rearward out of the container and into the barrel of the firearm, leaving the container body empty. When the ramrod is withdrawn from the barrel and the container body, the container cap is replaced in the container body for re-use.

Although but a few embodiments of the invention have been shown and described, it will be apparent to those skilled in the art that various changes and modifications may be made therein without departing from the spirit of the invention or from the scope of the appended claims.

What is claimed is:

1. A gunpowder charge and projectile container comprising in combination: tube means for containing a propellant charge and a lubricated conical projectile said tube means being made of a yeildable material and having two open ends, a first end opening for receiving and retaining said projectile, a second end opening for receiving a propellant charge, closure means for closing said second end opening said closure means being removable from said second end opening, retaining means mounted on said closure means for releaseably holding a percussion cap, said retaining means being axially spaced from said tube means when said closure means is mounted on said tube means, said retaining means being yeildable to release said percussion cap when said percussion cap is placed upon a breech nipple of a firearm, whereby when said projectile is removably held in said first end opening of said tube means and a propellant charge is inserted into said tube means and said second end opening is closed by said closure means, a projectile and a propellant charge is contained.

2. The structure as recited by claim 1 wherein: said tube means is cylindrical in shape and provided with a cylindrical bore passing throughout it's length.

3. The structure as recited by claim 2 wherein: said cylindrical bore passing through said tube means will allow a ramrod to pass through said tube means for pushing a projectile from within said tube means into the bore of a barrel of a firearm.

* * * * *